US009188098B2

(12) United States Patent
Kimura

(10) Patent No.: US 9,188,098 B2
(45) Date of Patent: Nov. 17, 2015

(54) STARTER

(71) Applicant: Mitsubishi Electric Corporation, Chiyoda-ku, Tokyo (JP)

(72) Inventor: Motoaki Kimura, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 265 days.

(21) Appl. No.: 14/051,710

(22) Filed: Oct. 11, 2013

(65) Prior Publication Data

US 2014/0109856 A1 Apr. 24, 2014

(30) Foreign Application Priority Data

Oct. 22, 2012 (JP) ..... 2012-233056

(51) Int. Cl.

| | |
|---|---|
| ***F02N 15/02*** | (2006.01) |
| ***F02N 15/06*** | (2006.01) |
| ***F02N 11/00*** | (2006.01) |
| *H01H 51/06* | (2006.01) |
| *F02N 11/08* | (2006.01) |

(52) U.S. Cl.

CPC ..... *F02N 11/00* (2013.01); *F02N 15/067* (2013.01); *F02N 11/087* (2013.01); *H01H 51/065* (2013.01); *Y10T 74/13* (2015.01); *Y10T 74/132* (2015.01)

(58) Field of Classification Search

CPC ... F02N 11/00; F02N 11/087; F02N 11/0851; F02N 15/067; F02N 15/023; F02N 15/046; F02N 15/065; Y10T 74/132; Y10T 74/13; H01H 1/065

USPC ..... 74/6–9; 123/185.1–185.15

See application file for complete search history.

(56) References Cited

U.S. PATENT DOCUMENTS

| | | | | |
|---|---|---|---|---|
| 4,983,941 | A * | 1/1991 | Tanaka | H01F 7/1607 335/255 |
| 5,012,686 | A * | 5/1991 | Morishita et al. | F02N 15/067 123/179.25 |
| 5,028,805 | A * | 7/1991 | Isozumi | F02N 15/067 290/48 |
| 5,038,626 | A * | 8/1991 | Morishita et al. | F02N 15/06 123/179.25 |
| 5,126,583 | A | 6/1992 | Isozumi et al. | |
| 5,349,319 | A | 9/1994 | Isozumi et al. | |
| 6,097,119 | A * | 8/2000 | Kuragaki et al. | F02N 11/00 310/89 |
| 7,038,564 | B1 * | 5/2006 | Kusumoto et al. | F02N 15/062 335/126 |

FOREIGN PATENT DOCUMENTS

| | | | |
|---|---|---|---|
| DE | 3910461 | A1 | 10/1989 |
| DE | 3925906 | A1 | 2/1990 |

(Continued)

OTHER PUBLICATIONS

Communication dated Jul. 13, 2015 from the German Patent Office in counterpart application No. 10 2013 221 284.4.

*Primary Examiner* — Hai Huynh
*Assistant Examiner* — Gonzalo Laguarda
(74) *Attorney, Agent, or Firm* — Sughrue Mion, PLLC

(57) ABSTRACT

A starter is disposed with an elastic body which generates slide resistance between the inner circumferential surface of a cylinder hole of a movable core and a first annular groove section of a flange section of a hook and the starter has an air damper function; and consequently, the effect of suppressing compression of a drive spring can be sufficiently obtained without reducing the suction speed of a plunger as much as possible and an engine can be rapidly started up.

3 Claims, 9 Drawing Sheets

(56) References Cited

FOREIGN PATENT DOCUMENTS

| | | | |
|---|---|---|---|
| JP | 59-131768 | A | 7/1984 |
| JP | 61-011457 | A | 1/1986 |
| JP | 61-046463 | A | 3/1986 |
| JP | 01-080744 | U | 5/1989 |
| JP | 02-057535 | U | 4/1990 |
| JP | 3542309 | B2 | 7/2004 |

* cited by examiner

STARTER

BACKGROUND OF THE INVENTION

1. Field of the Invention

The present invention relates to the structure of a starter which starts up an engine.

2. Description of the Related Art

In order to reliably perform opening and closing of a movable contact and a fixed contact of an electro agnetic switch, there is heretofore know a starter in which a spring is disposed between a lever that pushes out a pinion and a plunger. In such a starter, a configuration is made such that the plunger is sectioned by actuation of the electromagnetic switch and the lever engaged with the plunger pushes out the pinion; and thus, the pinion is meshed with a ring gear (for example, Patent Document 1).

In the aforementioned starter, the suction force of the plunger is strong against inertia of the pinion, an overrunning clutch to be pushed out in an axial direction together with the pinion, and the lever; and therefore, the spring may begin to be compressed in the initial motion of the plunger, that is, at the time when the plunger begins to be suctioned.

If the spring begins to be compressed in the initial motion of the plunger, the contacts close before the pinion is meshed with the ring gear; as a result, a problem exists in that the motor starts rotation, the motor rotation is transmitted, the rotating pinion and the ring gear are not meshed well, and what is called a meshing defect is generated.

As this countermeasure, generally, there includes a method which strengthens the spring; however, if the spring is strengthened, a drawback exists in that electromagnetic force of the electromagnetic switch, which is for overcoming against the countermeasure, needs to be increased and the electromagnetic switch increases in size. In addition, a problem exists in that if the electromagnetic force is increased, the momentum of the plunger is also increased and accordingly the spring needs to be further strengthened; and an effect by the method of increasing the electromagnetic force is slightly obtained regardless of the increase in size of the electromagnetic switch.

Furthermore, as another countermeasure, there is known one in which a starter includes: a first shaft disposed inside a plunger; a drive spring incorporated between the plunger and the first shaft; and a second shaft mounted with a movable contact and disposed inside the plunger. In the starter, the second shaft is rotatably borne to an inner diameter section of the first shaft so as to be a negative pressure by generating a space section between both of the shafts when both of the shafts move in an axial direction apart from each other at the time of actuation of the starter (for example, Patent Document 2). In this starter, airtightness of the space section between both of the shafts is enhanced so that an air damper function operates at the time of actuation of the starter and thus the momentum of the movement of the second shaft is suppressed and the momentum of the plunger is suppressed; and therefore, the contacts do not close before the pinion is meshed with the ring gear and consequently an effect can be obtained in that meshing property is improved.

[Patent Document 1] Japanese Unexamined Utility Model Publication No. Hei 2-57535 (FIG. 1)

[Patent Document 2] Japanese Examined Patent Publication No Hei 3-47430 (FIG. 2)

However, in the structure of the electromagnetic switch of the starter disclosed in Patent Document 2, the space section between both of the shafts enhances the airtightness by processing; and therefore, the space section is subject to variation in the negative pressure, an effect that suppresses the momentum of the plunger is unstable, and there cannot be stably obtained an effect that meshing property of the pinion and the ring gear is improved.

Furthermore, because of the structure which indirectly suppresses the compression of the drive spring by suppressing suction (movement) speed of the plunger, in order to sufficiently obtain the aforementioned air damper function, extremely high airtightness is required for the space section between both of the shafts, so that high process accuracy is needed and thus it could be factors of increased costs.

BRIEF SUMMARY OF THE INVENTION

The present invent ion has been made to solve the above described problem, and an object of the present invention is to provide a starter capable of stably obtaining an effect in that meshing property of a pinion and a ring gear is improved and capable of achieving a reduction in costs by structure simplification.

According to the present invention, there is provided a starter including a plunger and a pinion. The plunger includes: a movable core which moves by energization to an excitation coil; a hook in which a shaft portion is assembled in a cylinder hole provided in the movable core, a leading end section of the shaft portion is protruded from the movable core to be engaged with an end section of a shift lever, and a rear end section of the shaft portion is formed with a flange section; a bearing which is fixed to an opening section of the cylinder hole and through which the shaft portion passes through its inner diameter; and a drive spring which is inserted between the flange section and the bearing in the cylinder hole. The pinion moves via the shift lever which is driven in response to the movement of said movable core. In the starter, the outer circumferential surface of the flange section of the hook is formed with a first annular groove section along the circumferential direction thereof, and an elastic body is provided between the first annular groove section and the inner circumferential surface of the cylinder hole over the entire circumference, whereby the elastic body generates slide resistance between the movable core and the hook when the movable core and the hook are relatively moved while compressing the drive spring; and an internal space of the movable core is provided with an air damper function.

According to the starter of the present invention, the elastic body which generates slide resistance between the movable core and the hook is disposed, whereby the slide resistance is generated in the direction in which the drive spring tends to compress and compression of the drive spring can be suppressed. This allows preventing the drive spring from beginning to compress in the initial motion of the movable core, whereby contacts do not close before the pinion is meshed with the ring gear and a meshing defect of the pinion and the ring gear can be prevented to improve meshing property. Further, the structure is made such that the compression of the drive spring is suppressed by the slide resistance of the elastic body disposed between the movable core and the hook, whereby the effect of suppressing the compression of the drive spring can be stably and inexpensively obtained. In addition, the elastic body is provided on the first annular groove section, whereby the elastic body can be prevented from dropping from between the inner circumferential surface of the cylinder hole and the first annular groove section even if the movable core and the hook repeat relative movement in the axial direction. Further, the effect of suppressing the compression of the drive spring is sufficiently obtained by a large air damper function in the initial motion of the plunger; and on the other hand, an engine can be rapidly started up without reducing the suction speed of the plunger as much as possible by a small air damper function when the movable core operates while compressing the drive spring.

The foregoing and other objects, features, and advantageous effects of the present invention will become more apparent from detailed description in the following embodiments and description the accompanying drawings.

DETAILED DESCRIPTION OF THE INVENTION

Figure 1:
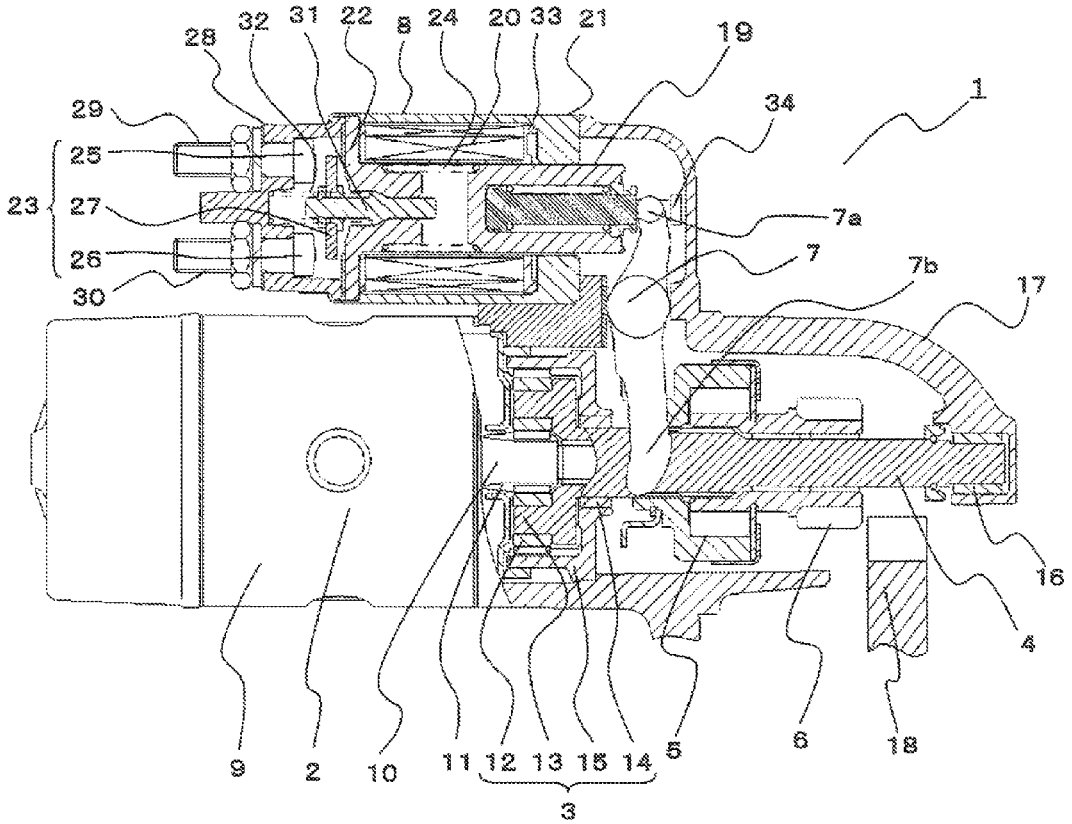
FIG. 1 is a partial sectional view showing the fundamental configuration of a starter according to Embodiment 1 of the present invention.

Hereinafter, respective embodiments in starters of the present invention will be described with reference to drawings. Incidentally, the same reference numerals as those shown in the respective drawings represent the same or corresponding elements.

Embodiment 1

Figure 2:
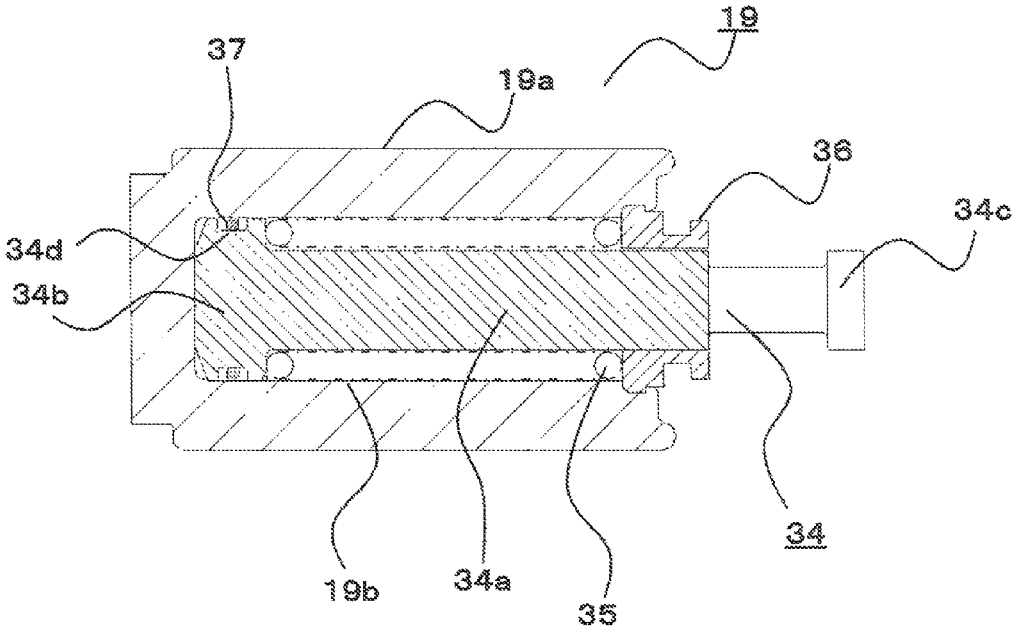
FIG. 2 is a relevant part sectional view of a plunger in FIG. 1.

FIG. 1 is a par al sectional view showing the fundamental configuration of a starter according to Embodiment 1 of the present invention; and FIG. 2 is a relevant part sectional view of a plunger in FIG. 1.

As shown in FIG. 1, a starter 1 includes: a motor 2 which generates rotational force; a reduction gear 3 which decelerates the rotation speed of the motor 2; an output shaft 4 which is driven by the motor 2 via the reduction gear 3; a pinion 6 which is disposed integrally with a clutch 5 on the output shaft 4; an electromagnetic switch 8 which pushes out the clutch 5 and the pinion 6 to a direction opposite to the motor (the right direction of FIG. 1) via a shift lever 7 and opens closes an energization circuit of the motor 2; and the like.

The motor 2 is a well known direct-current motor which has a field system (not shown in the drawing) which is formed by arranging plurality of permanent magnets (field coil may be permissible) on the inner circumference of a yoke 9 and an armature (not shown in the drawing) which is rotatably arranged on the inner circumference side of the field system, and which generates rotational force in the armature by the action of electromagnetic force generated by the field system.

The reduction gear 3 is a well known planetary gear reducer provided between an armature shaft 10 of the armature and the output shaft 4. The reduction gear 3 includes: a plurality of planetary gears 12 to be meshed with a sun gear 11 formed on the armature shaft 10; rotational shaft portions 13 which output the orbital motion of the planetary gears 12; and an internal gear 15 which is meshed with the planetary gears 12 and rotatably supports the rotational shaft portions 13 via a bearing 14. The planetary gears 12 move while rotating on their axes around the sun gear 11.

The output shaft 4 is disposed on the same axis line with the armature shaft 10 of the armature; one end side is provided integrally with the rotational shaft portions 13 of the reduction gear 3; and an end section of the other end side is rotatably supported to a front bracket 17 via a bearing 16.

The clutch 5 is configured as an unidirectional clutch which fitted to the outer circumference of the output shaft 4 in a helical spline manner and is disposed integrally with the pinion 6, and which transmits the rotation of the output shaft 4 to the pinion 6 and blocks torque transmission from the pinion 6 to the output shaft 4 when the rotation speed of the pinion 6 exceeds the rotation speed of the output shaft 4 by a start-up of an engine.

The pinion 6 is disposed on the side opposite to the motor 2 of the clutch 5, is moved in the direction opposite to the motor 2 on the output shaft 4 integrally with the clutch 5, and is meshed with a ring gear 18 of the engine; and thus, the pinion 6 transmits rotational force to the ring gear 18 via the clutch 5.

The shift lever 7 is pivotally disposed in the front bracket 17. A lever end section 7*a* on one end side is connected to a plunger 19 (to be described later) of the electromagnetic switch 8; and a lever end section 7*b* on the other end side is engaged with the clutch 5 to transmit the movement of the plunger 19 to the clutch 5. That is, when the plunger 19 is suctioned by an excitation coil 20 (to be described later) which forms an electromagnet of the electromagnetic switch 8 and is moved in the left direction of FIG. 1, the lever end section 7*a* connected to the plunger 19 is drawn by the plunger 19 and is moved; and thus, the lever end section 7*b* to be engaged with the clutch 5 is rocked to push out the clutch 5 to the direction of the ring gear 18.

The electromagnetic switch 8 includes: the excitation coil 20 in which a start-up switch (not shown in the drawing) is ON to be energized to form the electromagnet; a case 21 and a core 22 which form magnetic paths of the excitation coil 20; the plunger 19 which is suctioned by magnetic force generated by the excitation coil 20; a motor contact 23 (to be described later) provided in an energization circuit which is for flowing current from a battery (not shown in the drawing) to the motor 2; a plunger spring 24 which is for pushing back the plunger 19 when energization to the excitation coil 20 is stopped and the magnetic force is disappeared; and the like.

The motor contact 23 includes: a battery side fixed contact 25 and a motor side fixed contact 25 which are for flowing current from the battery to the motor 2; and a movable contact 27 which closes between the battery side fixed contact 25 and the motor side fixed contact 26 in connection with the movement of the plunger 19.

The battery side fixed contact 25 and the motor side fixed contact 25 are integrally formed with an end section of a battery side terminal bolt 29 and a motor side terminal bolt 30, respectively, the battery side terminal bolt 29 and the motor side terminal bolt 30 being mounted on a mold cover 28. Furthermore, the battery side terminal bolt 29 protruded outside the mold cover 28 is connected to the battery; and similarly, the motor side terminal bolt 30 protruded outside the mold cover 28 is connected to the motor 2.

The movable contact 27 is attached to a leading end of a shaft 31 and the plunger 19 is suctioned to move (move to the left side of FIG. 1) integrally with the shaft 31; and thus, the movable contact 27 comes into contact with the battery side fixed contact 25 and the motor side fixed contact 26.

A return spring 32 is provided between the mold cover 28 and the shaft 31 in order to return the movable contact 27, which comes into contact with the battery side fixed contact 25 and the motor side fixed contact 26, to a default position when the energization to the excitation coil 20 is stopped and the magnetic force of the excitation coil 20 is disappeared.

The plunger 19 is movably disposed on the inner circumference of a bobbin 33 around which the excitation coil 20 is wound; and the plunger 19 is biased to one side (the right direction of FIG. 1) in response to the elastic force of the plunger spring 24 disposed between the core 22 and the plunger 19.

The plunger 19 is connected to the clutch 5 via the shift lever 7 to be engaged with a hook 34 (to be described later); and the plunger 19 is suctioned to move, and thus the clutch 5 and the pinion 6 can be pushed out forward (the right direction of FIG. 1) via the shift lever 7.

Next, description will be made in detail on the configuration of the plunger 19 in FIG. 1.

As shown in FIG. 2, the plunger 19 includes a movable core 19*a* made of magnetic material; a drive spring 35 and a shaft portion 34*a* of the hook 34 which are inserted in a cylinder hole 19*b* formed in the movable core 19*a*; a bearing 36 which is fixed by caulking to an opening section of the cylinder hole 19*b* to support one end of the drive spring 35; and the like.

Incidentally, the shaft portion 34*a* of the hook 34 is configured to be movable in the axial direction along the inner diameter of the bearing 36.

Furthermore, the hook 34 is provided with a flange section 34*b*, which supports the other end of the drive spring 35, at a rear end section of the shaft portion 34*a* to be inserted in the cylinder hole 19*b* and is formed with an engaging section 34*c*, which is engaged with the lever end section 7*a* of the shift lever 7, at a leading end section of the shaft portion 34*a* to be protruded from the cylinder hole 19*b*.

A first annular groove section 34*d* is formed on the outer circumferential surface of the flange section 34*b* of the hook 34 along the circumferential direction thereof; and an annular elastic body 37 such as an O-ring is incorporated in the first annular groove section 34*d*. A configuration is made such that slide resistance is generated by the elastic body 37 between the inner circumferential surface of the cylinder hole 19*a* and the first annular groove section 34*d* of the flange section when the movable core 19*a* and the hook 34 are relatively moved in the axial direction while compressing or releasing the drive spring 35.

Next, the operation of the starter will be described.

First, when energization is performed from the battery to the excitation coil 20 by actuation of a key switch (not shown in the drawing), the plunger 19 is suctioned to move in the direction of the core 22. The clutch 5 and the pinion 6 are pushed out in the direction of the ring gear 18 via the hook 34 and the shift lever 7 in connection with the movement of the plunger 19, so that the pinion 6 is meshed with the ring gear 18.

At this time, when axial end faces of the pinion 6 and the ring gear 18 come in contact, the pinion 6 cannot move forward in the axial direction any longer and the pinion 6 cannot be meshed with the ring gear 18.

So, after the pinion 6 comes into contact with the end face of the ring gear 18, only the movable core 19*a* moves in the direction of the core 22 while compressing the drive spring 35; and the movable contact 27 attached to the shaft 31 comes into contact with the battery side fixed contact 25 and the motor side fixed contact 26 to close the motor contact 23.

When the motor contact 23 closes, the motor 2 generates rotational force and its rotational force is transmitted to the pinion 6 via the reduction gear 3 and the output shaft 4; and thus, the pinion 6 moves to a position capable of meshing on the end face of the ring gear 18.

In this case, the pinion 6 moved to the position capable of meshing with the ring gear 18 can move forward again in the axial direction via the hook 34 and the shift lever 7 by a force in which the compressed drive spring 35 tends to restore, so that the pinion 6 can be meshed with the ring gear 18.

In a series of such motions, an ideal motion is that the drive spring 35 does not begin to compress in the initial motion of the plunger 19, that is, the movable core 19*a* and the hook 34 move in an integrated manner to a suction direction. However, in the conventional starter structure, the suction force of the plunger strong against inertia of the pinion 6, the clutch 5, and the shift lever 7; and thus, the drive spring 35 begins to compress at the time when the plunger 19 begins to be suctioned. Accordingly, the motor contact 23 closes before the pinion 6 comes into contact with the ring gear 18 and the pi ion 6 begins to rotate; and therefore, a meshing defect is likely to be generated.

In this case, according to the starter 1 in the present embodiment, even if the suction force of the plunger 19 is strong against the inertia of the pinion 6, the clutch 5, and the shift lever 7, the elastic body 37 which generates slide resistance between the movable core 19*a* and the hook 34 and, more particularly, between the inner circumferential surface of the cylinder hole 19*b* of the movable core 19*a* and the first annular groove section 34*b* of the flange section 34*b* of the hook 34 is disposed; and therefore, the slide resistance is generated in the direction in which the drive spring 35 tends to compress and compression of the drive spring 35 can be suppressed.

As a result, the drive spring 35 can be prevented from beginning to compress in the initial motion of the plunger 19 and therefore, the motor contact 23 does not close before the pinion 6 is meshed with the ring gear 18, the meshing defect of the pinion 6 and the ring gear 18 can be prevented, and meshing property is improved.

Further, the compression of the drive spring 35 is not suppressed by enhancing airtightness by processing as in the starter of the conventional structure; but the structure made such that the compression of the drive spring 35 is suppressed by the slide resistance of the elastic body 37 disposed between the movable core 19*a* and the hook 34; and therefore, the effect of suppressing the compression of the drive spring 35 can be stably and inexpensively obtained.

Furthermore, in the present embodiment, the annular elastic body 37 is provided on the first annular groove section 34*d* formed on the outer circumferential surface of the flange section 34*b* of the hook 34; and therefore, even if the movable core 19*a* and the hook 34 repeat relative movement in the axial direction, the elastic body 37 can be prevented from dropping from between the inner circumferential surface of the cylinder hole 19*a* and the first annular groove section 34.

Figure 3:
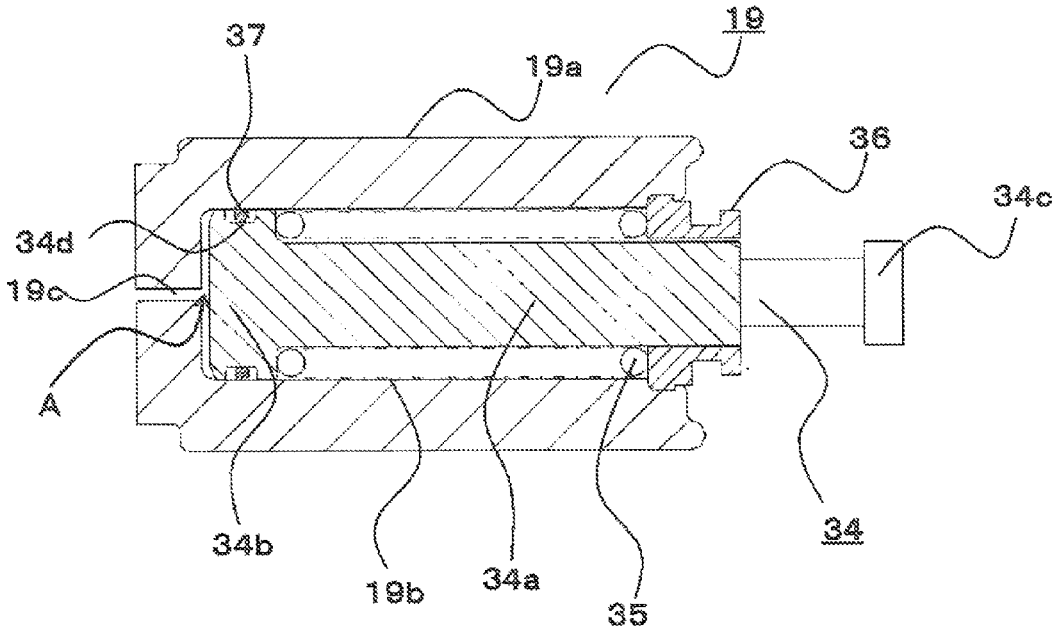
FIG. 3 is a relevant part sectional view showing other example of the plunger in FIG. 1.

FIG. 3 is a relevant part sectional view showing other example of the plunger and shows a state where a drive spring 35 is slightly compressed. In the drawing, an elastic body 37 is provided over the entire circumference of a first annular groove section 34*d* of a hook 34.

Furthermore, a first communication path 19*c*, in which a first internal space A of a movable core 19*a* surrounded by a cylinder hole 19*b*, the elastic body 37, and a flange section 34*b* communicates with an external space of the movable core 19*a* with each other, is formed in the movable core 19*a*. Other configuration is similar to the plunger 19 of FIG. 1 and therefore detail description will be omitted.

In the aforementioned structure, in the case where the elastic body 37 is provided over the entire circumference of the first annular groove section 34*d*, the first al space A becomes a sealed space; and when the plunger 19 is suctioned, the first internal space A becomes negative pressure. Therefore, a larger suppression effect than the effect of suppressing the compression of the drive spring 35 by the slide resistance of the elastic body 37 can be obtained.

However, if the effect of suppressing the compression of the drive spring 35 is larger than necessary by the slide resistance of the elastic body 37 and the negative pressure of the first internal space A, it is conceivable that the suction speed of the plunger 19 becomes late when the movable core 19*a* moves while compressing the drive spring 35 after the pinion 6 comes into contact with the end face of the ring gear 18, so that the time until the motor contact 23 closes is elongated and a rapid start-up of the engine cannot be performed.

On the other hand, it is also conceivable the case where a desired effect of suppressing the compression of the drive spring 35 cannot be obtained depending on the size of the suction force of the plunger 19 by only the slide resistance obtained in the case where the elastic body 37 is partially disposed on the first annular groove section 34*d*.

So, the configuration is made such that the first communication path 19*c*, in which the first internal space A of the movable core 19*a* communicates with the external space of the movable core 19*a* with each other, formed in the movable core 19*a* so as to have an air damper function by resistance of the air flowing in from the first communication path 19*c* to the first internal space A when the plunger 19 is suctioned. If a flow path area of the first communication path 19*c* is small, a large air damper function is obtained; conversely, if the flow path area is large a small air damper function is obtained.

In this manner, the size of the flow path area of the first communication path 19*c* is set as needed and the air damper function is adjusted; and thus, a desired effect of suppressing the compression of the drive spring 35 can be easily obtained.

Figure 4A:
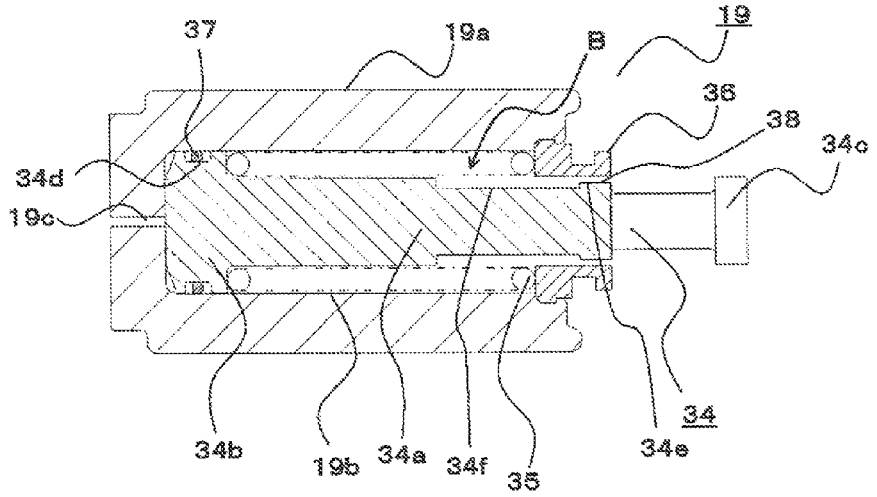
FIG. 4A and FIG. 4B are each a relevant part sectional view of the plunger according to Embodiment 1 of the present invention.
Figure 4B:
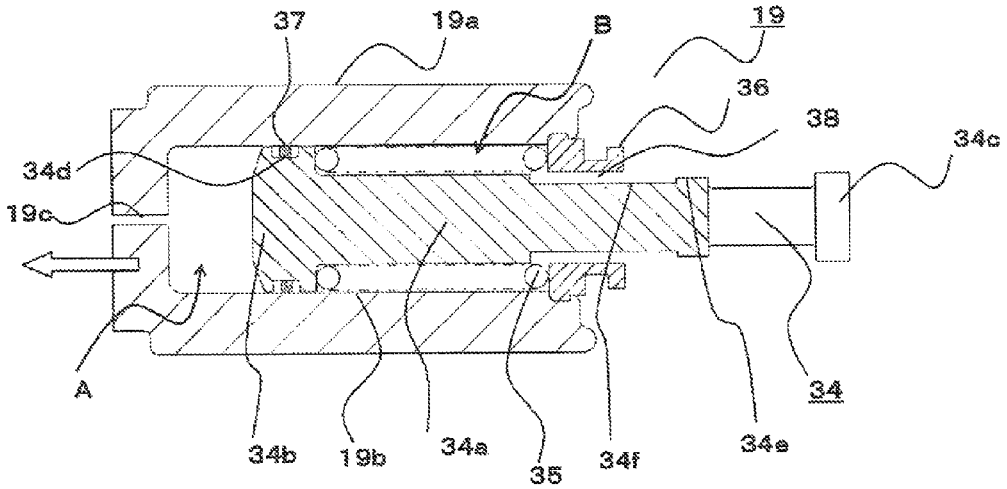

FIGS. 4A and 4B are each a relevant part sectional view showing other modified example of the plunger according to Embodiment 1 of the present invention; FIG. 4A is a sectional view showing a state of a position (stationary position) before the operation of the plunger; and FIG. 4B is a sectional view showing a state in which the plunger operates while compressing a drive spring.

This modified example has a first flow path groove section 34*e* formed at the leading end side of a shaft portion 34*a* of a hook 34 along the axial direction thereof and has a first flow path area enlarged section 34*f* (to be described in detail later) formed at the axial rear end side of the first flow path groove section 34*e*. The first flow path area enlarged section 34*f* is a groove section deeper than the depth of the first flow path groove section 34*e*.

Other configuration is similar to the plunger 19 shown in FIG. 3 and therefore detailed description will be omitted.

In such a configuration, a second communication path 38, in which a second internal space B of the movable 19*a* surrounded by the cylinder hole 19*b*, the bearing 36, the hook 34, and the annular elastic body 37 communicates with an external space of the movable core 19*a* with each other, is formed by a radial air gap between the bearing 36 and the first flow path groove section 34*e* and a radial air gap between the bearing 36 and the first flow path area enlarged section 34*f*.

Therefore, a flow path area by the second communication path 38 at the time before the operation of the plunger 19 (a stationary position) is determined by the radial air gap between the bearing 36 and the first flow path groove section 34*e* as shown in FIG. 4A; and a flow path area by the second communication path 38 in the case where the movable core 19*a* is located at a position moving while compressing the drive spring 35 is determined by the radial air gap between the bearing 36 and the first flow path area enlarged section 34*f* as shown in FIG. 4B.

In this case, the flow path area of the second communication path 38 formed by the radial air gap between the bearing 36 and the first flow path groove section 34*e* is set to be smaller than the flow path area of the first communication path 19*c*; and the flow path area formed by the radial air gap between the bearing 36 and the first flow path area enlarged section 34*f* is set to be larger than the flow path area of the first communication path 19*c*.

In other words, the flow path area by the second communication path 38 located at the position (the stationary position) before the operation of the plunger 19 is set to be smaller than the flow path area of the first communication path 19*c*; and the flow path area by the second communication path 38 at the time when the movable core 19*a* operates while compressing the drive spring 35 is set to be larger than the flow path area of the first communication path 19*c*.

Consequently, in the initial motion of the plunger 39, the amount of air which flows in from the external space of the movable core 19*a* to the first internal space A of the movable core 19*a* via the first communication path 19*c* is less than the amount of air which flows out from the second internal space B of the movable core 19*a* to the external space of the movable core 19*a* via the second communication path 38; and therefore, a large air damper function is generated on the basis of the flow path area of the second communication path 38.

On the other hand, when the movable core 19*a* moves while compressing the drive spring 35, the amount of air which flows in from the external space of the movable core 19*a* to the first internal space A of the movable core 19*a* via the first communication path 19*c* is more than the amount of air which flows out from the second internal space B of the movable core 19*a* to the external space of the movable core 19*a* via the second communication path 38; and therefore, a small air damper function is generated on the basis of the flow path area of the first communication path 19*c*.

In this manner, the effect of suppressing the compression of the drive spring 35 is sufficiently obtained by the large air damper function by the first communication path 19*c* and the second communication path 38 in the time of the initial motion of the plunger 19; and on the other hand, when the movable core 19*a* operates while compressing the drive spring 35, the suction speed of the plunger 19 is not reduced as much as possible and the engine can be rapidly started up by the small air damper function by the first communication path 19*c* and the second communication path 38.

Embodiment 2

Figure 5:
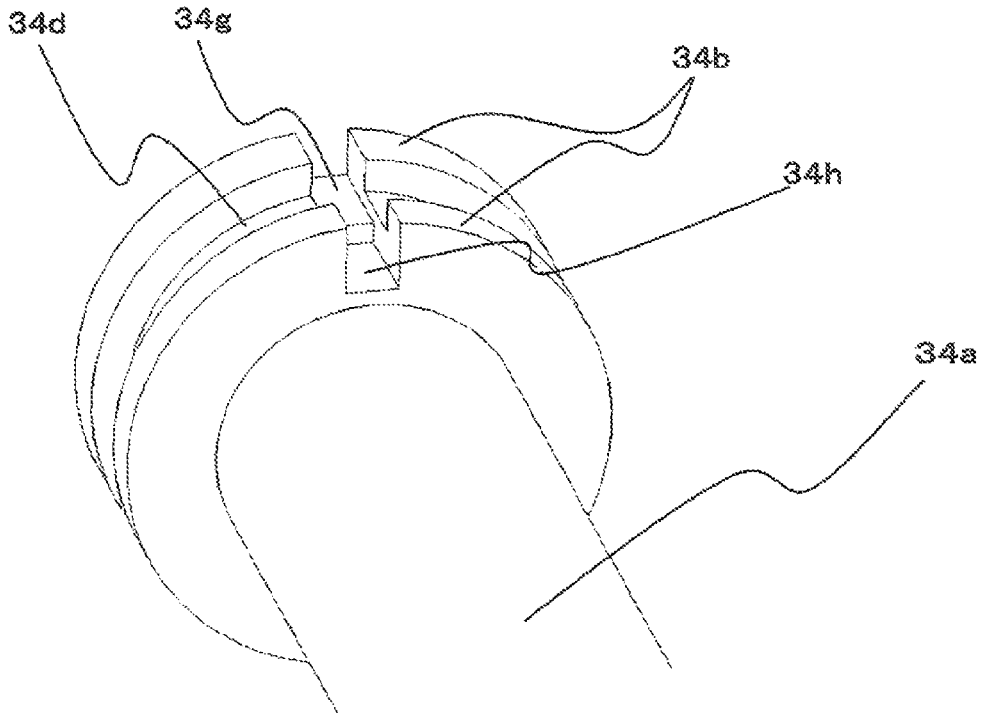
FIG. 5 is a relevant part perspective view showing a flange section of a hook according to Embodiment 2 of the present invention.
Figure 6A:
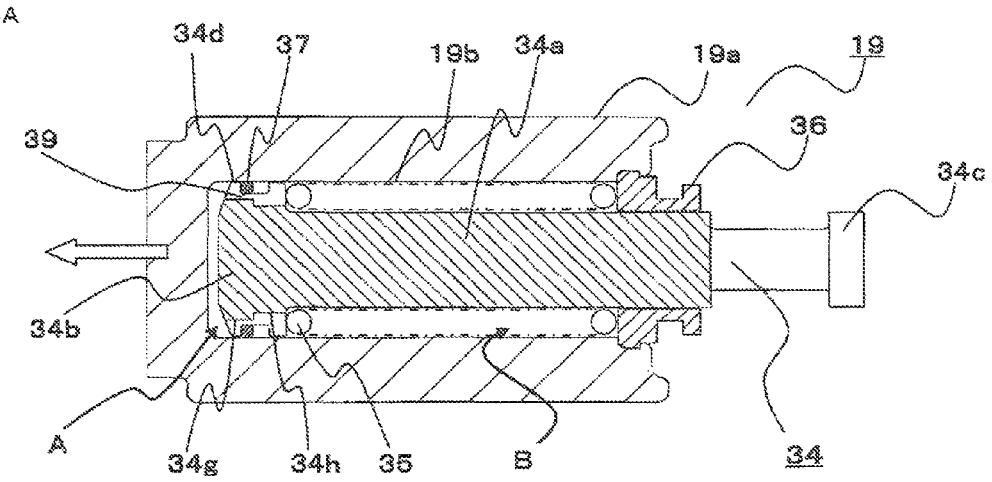
FIG. 6A and FIG. 6B are each a relevant part sectional view of a plunger according to Embodiment 2 of the present invention.
Figure 6B:
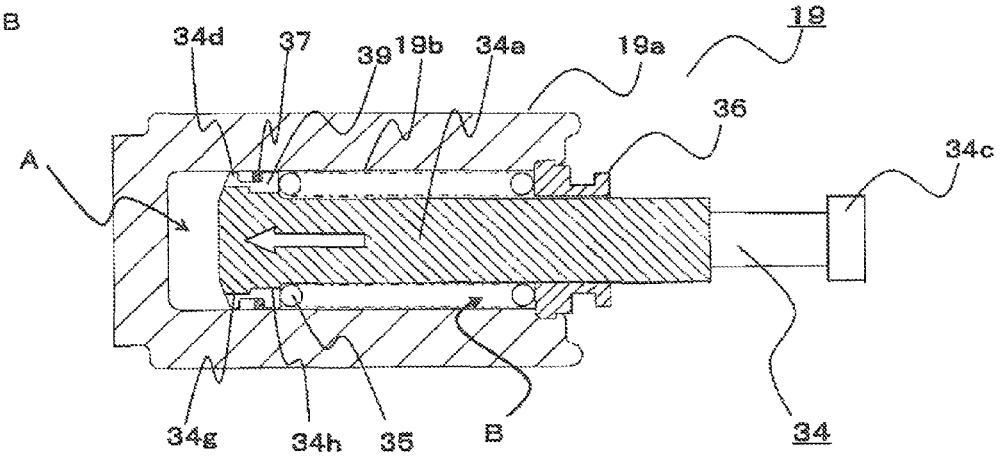

FIG. 5 is a relevant part perspective view showing a flange section of a hook 34 according to Embodiment 2 of the present invention. FIG. 6A and FIG. 6B are each a relevant part sectional view of a plunger according to Embodiment 2 of the present invention; FIG. 6A is a sectional view showing a state where a movable core moves while compressing a drive spring; and FIG. 6B is a sectional view showing a state where the hook moves while releasing the drive spring.

In the present Embodiment 2, an elastic body 37 is annularly provided over the entire circumference of a first annular groove section 34*d* provided on the hook 34.

Further, a configuration is made such that the first annular groove section 34*d* is formed with a second flow path groove section 34*g* which is extended in an axial direction and is deeper than the depth of the first annular groove section 34*d* as shown in FIG. 5; the second flow path groove section 34*q* is further formed with a second flow path area enlarged section 34*h* (to be described in detail later) on the axial leading end side, the second flow path area enlarged section 34*h* being a groove section deeper than the depth of the second flow path groove section 34*g*; and a first internal space A of a movable core 19*a* surrounded by a cylinder hole 19*b*, the elastic body 37, and a flange section 34*b* communicates with a second internal space B of the movable core 19*a* surrounded by the cylinder hole 19*b*, the bearing 36, the hook 34, and the annular elastic body 37.

Incidentally, the second flow path groove section 34*g* and the second flow path area enlarged section 34*h* are not stepwise; but, for example, it may be formed in a tapered shape whose depth becomes deeper from the second flow path groove section 34*g* toward the second flow path area enlarged section 34*h*.

Furthermore, the configuration is made such that the axial length of the elastic body 37 is shorter than the axial length of the first annular groove section 34*d* so that the elastic body 37 is movable in the axial direction in the first annular groove section 34*d*.

Other configuration of a plunger 19 is similar to the plunger 19 of the aforementioned FIG. 2 and therefore detail description will be omitted.

If the configuration is made in such a manner, at the time before the pinion 6 comes into contact with the ring gear 1.8 from the initial motion of the plunger 19, as shown in FIG. 6A, the movable core 19*a* moves in the suction direction and thus a slight compression is generated in the drive spring 35 and the hook 34 slightly, relatively moves in the compressing direction of the drive spring 35 in the movable core 19*a*. In this case, the elastic body 37 does not follow the movement of the hook 34 and the elastic body 37 slides on the first annular groove section 34*d* and the cylinder hole 19*b*; and then, the elastic body 37 comes near the axial rear end side in the first annular groove section 34*d*, that is, the second flow path groove section 34*g* side.

At this time, there is formed a third communication path 39 in which the first internal space A of the movable core 19*a* surrounded by the cylinder hole 19*a*, the elastic body 37, and the flange section 34*b* communicates with the external space of the movable core 19*a* with each other by a radial air gap between the elastic body 37 and the second flow path groove section 34*g* in the first annular groove section 34*d*.

On the other hand, after the movable core 19*a* continues to move and the motor contact 23 closes also after the pinion 6 comes into contact with the ring gear 18, the pinion 6 moves to a posit capable of meshing with the ring gear 18 and the pinion 6 moves forward again in the axial direction to mesh with the ring gear 18 via the hook 34 and the shift lever 7 by a force in which the compressed drive spring 35 tends to restore.

In this process, as shown in FIG. GB, the hook 34 moves in the releasing direction of the drive spring 35 in the movable core 19*a* by the force in which the drive spring 35 tends to restore. In this case, the elastic body 37 does not follow the movement of the hook 34 and the elastic body 37 slides on the first annular groove section 34*d* of the hook 34 and the cylinder hole 19*b* of the movable core 19*a*; and thus, the elastic body 37 comes near the axial leading end side in the first annular groove section 34*d*, that is, the second flow path area enlarged section 34*h* side.

At this time, there is formed the third communication path 39 by which the first internal space A of the movable core 19*a* communicates with the second internal space B of the movable core 19*a* by a radial gap between the elastic body 37 and the second flow path area enlarged section 34*h* in the first annular groove section 34*d*.

The configuration is made in such a manner and thus a flow path area of the third communication path 39 formed by the radial air gap between the elastic body 37 and the second flow path groove section 34*g* is smaller than a flow path area of the third co cation path 39 formed by the radial air gap between the elastic body 37 and the second flow path area enlarged section 34*h*.

In the present embodiment, the configuration is made such that the third communication path 39, in which the first internal space A of the movable core 19*a* communicates with the second internal space B of the movable core 19*a*, is famed by the radial air gap between the elastic body 37 and the second flow path groove section 34*g* so as to have an air damper function by resistance of the air flowing out from the first internal space A via the third communication path 39 in the initial motion of the plunger 19.

Therefore, if the flow path area of the third communication path 39 is set to be small, a large air damper function is obtained; conversely, if the flow path area is set to be large, a small air damper function is obtained.

In this manner, the size of the flow path area of the third communication path 39 is set as needed and the air damper function is adjusted; and thus, a desired effect of suppressing the compression of the drive spring 35 can be easily obtained.

Furthermore, in the present embodiment, at the time before the pinion 6 comes into contact with the ring gear 18 from the initial motion of the plunger 19, the air flows out from the first internal space A of the movable core 19*a* to the second internal space B of the movable core 19*a* by the third communication path 39 formed by the radial air gap between the elastic body 37 and the second flow path groove section 34*g*; and the flow path area of the third communication path 39 is small and thus the effect of suppressing the compression of the drive spring 35 can be sufficiently obtained by the slide resistance of the elastic body 37 and the large air damper function by the third communication path 39.

On the other hand, after the motor contact 23 closes, the air flows out from the first internal space A of the movable core 19*a* to the second internal space B of the movable core 19*a* by the third communication path 39 formed by the radial air gap between the elastic body 37 and the second flow path area enlarged section 34*h*; and the flow path area of the third communication path 39 is large and thus the air damper function by the third communication path 39 is small, so that the pinion can be rapidly meshed with the ring gear.

Figure 7:
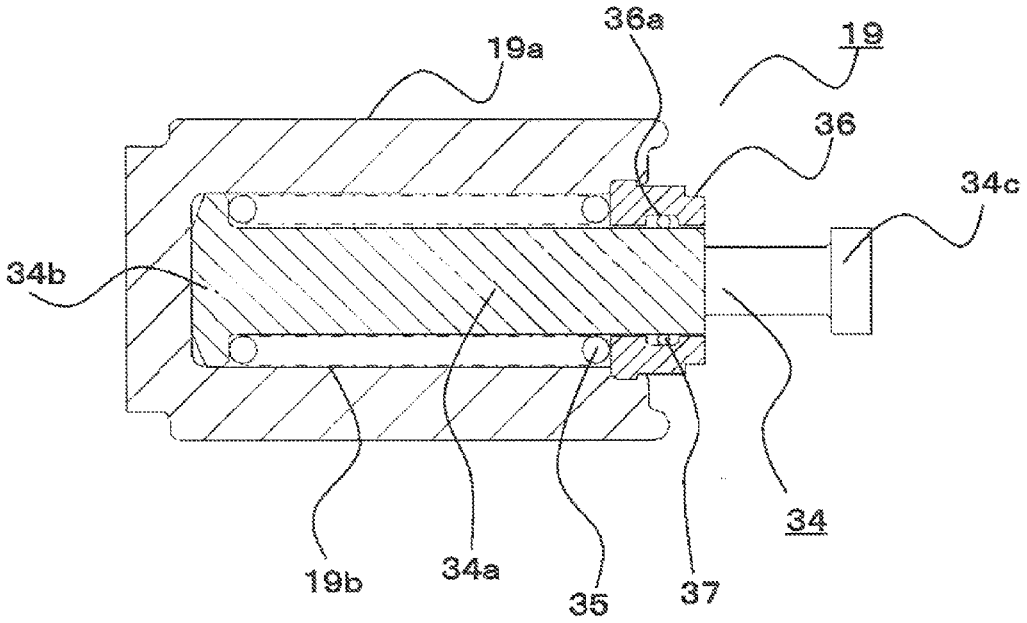
FIG. 7 is a relevant part sectional view showing other example the plunger.
Figure 8:
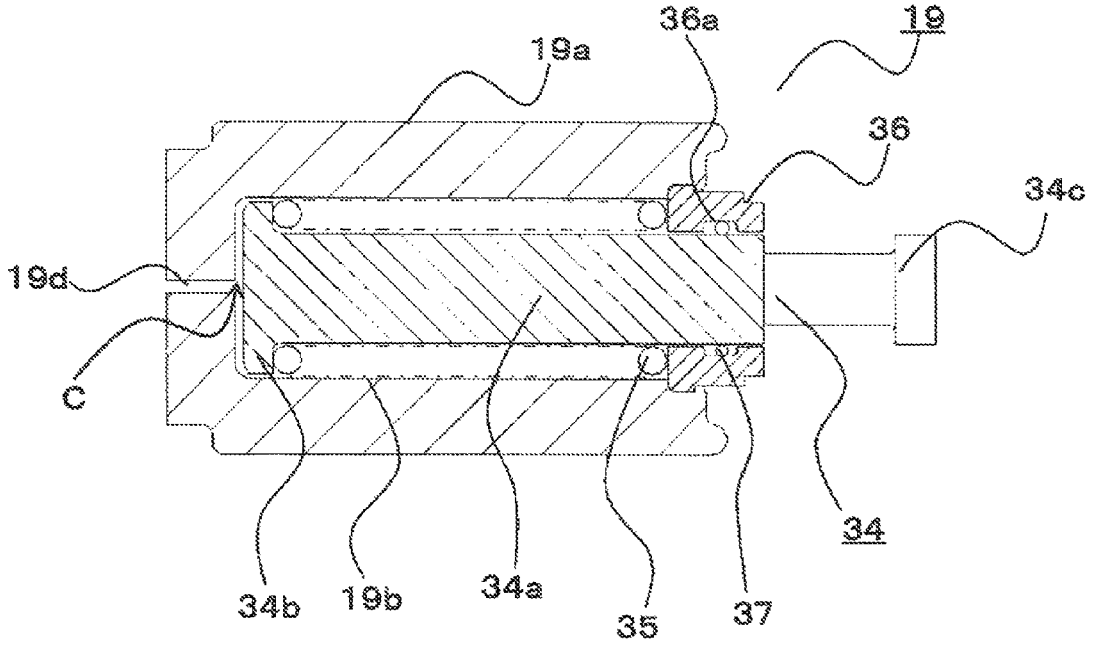
FIG. 8 is a relevant part sectional view showing other modified example of the plunger.

FIG. 7 is a sectional view showing other example of the plunger. In the aforementioned embodiments, the elastic body 37 is provided on the flange section 34*b* of the hook 34. However, in FIG. 7, a configuration is made such that an elastic body 37 is provided on at least a part of a second annular groove section 36*a* formed on the inner circumferential surface of a bearing 36 along the circumferential direction thereof; and slide resistance by the elastic body 37 can be generated between the inner circumferential surface of the bearing 36 and the outer circumferential surface of a shaft portion 34*a* of a hook 34.

According to this configuration, the elastic body 37 which generates the slide resistance is disposed between a movable core 19*a* and the hook 34 and, more particularly, between the inner circumferential surface of the bearing 36 fixed to the movable core 19*a* and the shaft portion 34*a* of the hook 34; and therefore, the slide resistance is generated in the direction in which a drive spring 35 tends to compress and compression of the drive spring 35 can be suppressed.

As a result, the drive spring 35 can be prevented from beginning to compress in the initial motion of the plunger 19; and therefore, the motor contact 23 does not close before the pinion 6 is meshed with the ring gear 18, a meshing defect of the pinion 6 and the ring gear 18 can be prevented, and meshing property is improved.

Furthermore, in the present embodiment, the elastic body 37 is provided on the second annular groove section 36*a* formed on the inner circumferential surface of the bearing 36 along the circumferential direction thereof; and therefore, even if the bearing 36 fixed to the movable core 19*a* and the shaft portion 34*a* of the hook 34 repeat relative movement in the axial direction, the elastic body 37 can be prevented from dropping from between the shaft portion 34*a* of the hook 34 and the second annular groove section 36*a* of the bearing 36.

FIG. 6 is a sectional view showing other modified example of the plunger and the view showing a state where a drive spring 35 is slightly compressed.

In this modified example, a configuration is made such that an elastic body 37 is provided over the entire circumference of a second annular groove section 36*a* of a hook 34; and a fourth communication path 19*d*, in which a third internal space C of a movable core 19*a* surrounded by a cylinder hole 19*b*, a bearing 36, the elastic body 37, and the hook 34 communicates with an external space of the movable core 19*a* with each other, is formed in the movable core 19*a* so as to have an air damper function by resistance of the air flowing in from the fourth communication path 19*d* to the third internal space C when a plunger 19 is suctioned.

Other configuration of such a plunger 19 is similar to the plunger 19 of FIG. 3 and therefore detail description will be omitted.

The configuration is made in such a manner and thus a large air damper function is obtained if a flow path area of the fourth communication path 19*d* is set to be small; conversely, if the flow path area is set to be large, a small air damper function is obtained.

In this manner, the size of the flow path area of the fourth communication path 19*d* is set as needed and the air damper function is adjusted; and thus, a desired effect of suppressing compression of the drive spring 35 can be easily obtained.

Figure 9:
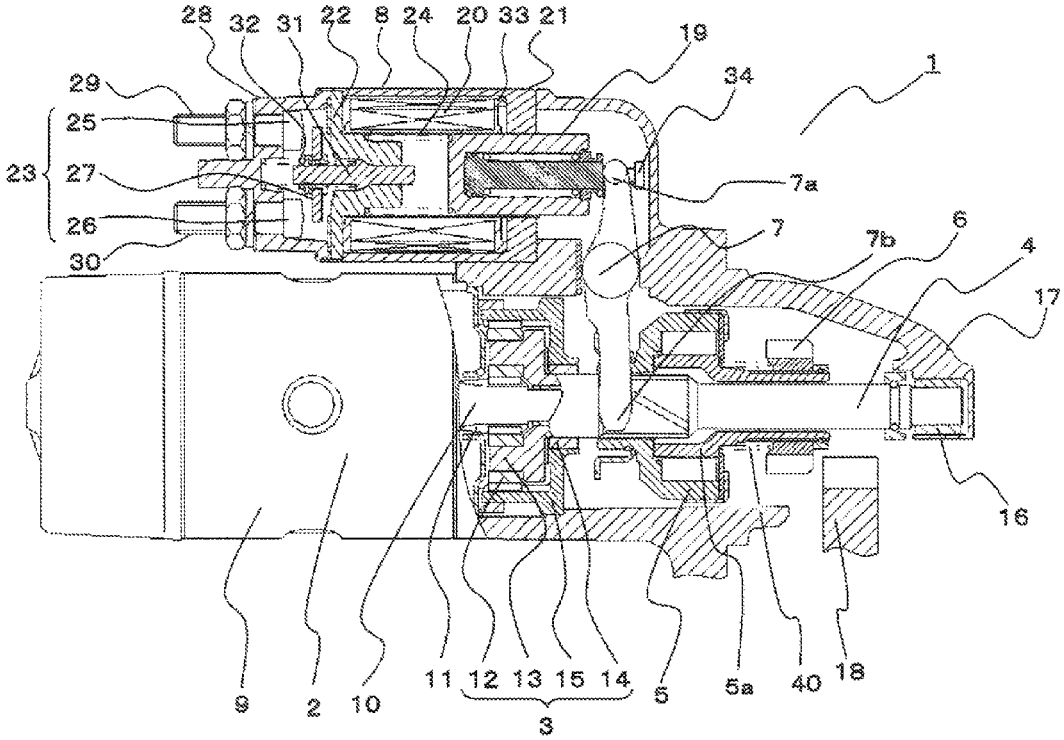
FIG. 9 is a partial sectional view showing other example of a starter to which the present invention is applied.

FIG. 9 is a partial sectional view showing other example of the starter to which the present invention is applied. In the starter 1 in FIG. 1, the clutch 5 is fitted to the outer circumference of the output shaft 4 in the helical spline manner and is disposed integrally with the pinion 6. However, in a starter 1 in the present embodiment, a pinion shaft 5*a* located inside the clutch 5 and a pinion 6 are separately configured; a pinion spring 40 is disposed between the pinion shaft 5*a* and the pinion 6, the pinion spring 40 being for storing axial reaction force between both of the pinion shaft 5*a* and the pinion 6; and the pinion 6 is movably supported by a predetermined distance in the axial direction with respect to the pinion shaft 5*a*. Such a starter 1 is also a well known structure.

In such a structure, the pinion spring 40 is set to be smaller than a load of a drive spring 35.

Incidentally, the plungers 19 in Embodiments 1 and 2 can be applicable to the structure of a plunger 19 in FIG. 9.

Next, operation in the starter of such a structure will be described.

First, when energization is performed from a battery to an excitation coil 20 by actuation of a key switch (not shown in the drawing), the plunger 19 is suctioned to move in the direction of a core 22 (the left direction in FIG. 1). The clutch 5 and the pinion 6 are pushed out in the direction of a ring gear 18 via a hook 34 and a shift lever 7 in connection with the movement of the plunger 19, and the pinion 6 is meshed with the ring gear 18.

At this time, when axial end faces of the pinion 6 and the ring gear 18 come into contact, the pinion 6 cannot move forward any longer and the pinion 6 cannot be meshed with ring gear 18.

So, in the present structure, after the pinion 6 comes into contact with the end face of the ring gear 18, first, only the clutch 5 moves forward on the output shaft 4 while compressing the pinion spring 40. At this time, the pinion 6 relatively moves backward on a pinion shaft 23 by forward movement of the clutch 5 and moves to a position capable of meshing with the ring gear 18 while storing reaction force in the pinion spring 40. The pinion 6 moved to the position capable of meshing with the ring gear 18 is meshed with the ring gear 18 by the reaction force stored in the pinion spring 40.

After that, a motor contact 23 closes by the continuously suctioned plunger 19 and motor rotation is transmitted to the ring gear 18 via the pinion 6.

Conventionally, the suction force of the plunger 19 is strong against inertia of the pinion 6, the clutch 5, and the shift lever 7 even the starter of such a meshing type; and thus, the drive spring 35 may begin to compress at the time when the plunger 19 begins to be suctioned, the motor contact 23 closes before the pinion 6 is meshed with the ring gear 18 by the reaction force stored in the pinion spring 40 and the pinion 6 begins to rotate; and therefore, a meshing defect is likely to be generated.

Therefore, the drive spring 35 can be prevented from beginning to compress in the initial motion of the plunger 19 even by applying the present invention to the starter of such a meshing type; and therefore, the motor contact 23 does not close before the pinion 6 is meshed with the ring gear 18, a meshing defect of the pinion 6 and the ring gear 18 can be prevented, and meshing property is improved.

Further, the compression of the drive spring 35 is not suppressed by enhancing airtightness by processing as in the starter of the conventional structure; but the structure is made such that the compression of the drive spring 35 is suppressed by slide resistance of the elastic body 37 disposed between the movable core 19*a* and the hook 34; and therefore, the effect of suppressing the compression of the drive spring 35 can be stably and inexpensively obtained.

EXPLANATIONS OF LETTERS OR NUMERALS

1: Starter,
6: Pinion,
7: Shift lever,
7*a*: Lever end section,
19: Plunger,
19*a*: Movable core,
19*b*: Cylinder hole,
19*c*: First communication path,
19*d*: Fourth communication path,
20: Excitation coil,
34: Hook,
34*a*: Shaft portion
34*b*: Flange section,

34*c*: Engaging section,
34*d*: First annular groove section
34*e*: First flow path groove section,
34*f*: First flow path area enlarged section,
34*g*: Second flow path groove section
34*h*: Second flow path area enlarged section,
35: Drive spring,
36: Bearing
36*a*: Second annular groove section,
37: Elastic body,
38: Second communication path
39: Third communication path,
A: First internal space,
B: Second internal space,
C: Third internal space Various modifications and alternations of this invention will be apparent to those skilled in the art without departing from the scope and spirit of this invention, and it should be understood that this is not limited to the illustrative embodiments set forth herein.

What is claimed is:

1. A starter comprising a plunger and a pinion, said plunger including:

a movable core which moves by energization to an excitation coil;

a hook in which a shaft portion is assembled in a cylinder hole provided in said movable core, a leading end section of said shaft portion is protruded from said movable core to be engaged with an end section of a shift lever, and a rear end section of said shaft portion is formed with a flange section;

a bearing which is fixed to an opening section of said cylinder hole and through which said shaft portion passes through its inner diameter; and a drive spring which is inserted between said flange section and said bearing in said cylinder hole, and said pinion moving via said shift lever which is driven in response to the movement of said movable core, wherein the outer circumferential surface of said flange section of said hook is formed with a first annular groove section along the circumferential direction thereof, and an elastic body is provided between said first annular groove section and the inner circumferential surface of said cylinder hole over the entire circumference, whereby said elastic body generates slide resistance between said movable core and said hook when said movable core and said hook are relatively moved while compressing said drive spring; and wherein said movable core is formed with a first communication path by which a first internal space (A) of said movable core surrounded by said cylinder hole, said elastic body, and said flange section communicates with an external space of said movable core with each other;

the leading end side of said shaft portion is formed with a first flow path groove section along the axial direction, whereby a second communication path, by which a second internal space (B) of said movable core surrounded by said cylinder hole, said bearing, said hook, and said elastic body communicates with the external space of said movable core with each other, is formed between said bearing and said shaft portion; and said shaft portion is formed with a first flow path area enlarged section on the axial rear end side of said first flow path groove section so that a flow path area of said second communication path is smaller than a flow path area of said first communication path when said movable core is located at a stationary position, and the flow path area of said second communication path is larger than the flow path area of said first communication path when said movable core is located at a position moving while compressing said drive spring.

2. A starter comprising a plunger and a pinion, said plunger including:

a movable core which moves by energization to an excitation coil;

a hook in which a shaft portion is assembled in a cylinder hole provided in said movable core, a leading end section of said shaft portion is protruded from said movable core to be engaged with an end section of a shift lever, and a rear end section of said shaft portion is formed with a flange section;

a bearing which is fixed to an opening section of said cylinder hole and through which said shaft portion passes through its inner diameter; and a drive spring which is inserted between said flange section and said bearing in said cylinder hole, and said pinion moving via said shift lever which is driven in response to the movement of said movable core, wherein the outer circumferential surface of said flange section of said hook is formed with a first annular groove section along the circumferential direction thereof, and an elastic body is provided between said first annular groove section and the inner circumferential surface of said cylinder hole over the entire circumference, whereby said elastic body generates slide resistance between said movable core and said hook when said movable core and said hook are relatively moved while compressing said drive spring; and wherein said first annular groove section is formed with a second flow path groove section along an axial direction, whereby a gap surrounded by said second flow path groove section and said elastic body forms a third communication path in which a first internal space (A) of said movable core surrounded by said cylinder hole, said elastic body, and said flange section communicates with a second internal space (B) of said movable core surrounded by said cylinder hole, said bearing, said hook, and said elastic body with each other.

3. The starter according to claim 2, wherein the axial length of said first annular groove section is a length in which said elastic body is movable in the axial direction when said movable core and said hook are relatively moved, and said shaft portion is formed with a second flow path area enlarged section on the axial leading end side of said second flow path groove section so that a flow path area of said third communication path in the case where said elastic body moves to the axial rear end side in said first annular groove section is smaller than a flow path area of said third communication path in the case where said elastic body moves to the axial leading end side in said first annular groove section.

* * * * *